US006460184B1

(12) United States Patent
Nishimura et al.

(10) Patent No.: US 6,460,184 B1
(45) Date of Patent: Oct. 8, 2002

(54) BASEBALL GLOVE

(75) Inventors: Toshiaki Nishimura, Osaka (JP); Junichi Dogan, Osaka (JP); Kazuhiro Kume, Osaka (JP); Masaki Terashita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 10/015,132

(22) Filed: Dec. 11, 2001

(30) Foreign Application Priority Data

Apr. 6, 2001 (JP) ..... 2001-107973

(51) Int. Cl.[7] ..... A41D 13/08
(52) U.S. Cl. ..... 2/19
(58) Field of Search ..... 2/16, 19, 20, 158, 2/159, 161.1, 161.2, 167, 169

(56) References Cited

U.S. PATENT DOCUMENTS

| | | | | |
|---|---|---|---|---|
| 4,065,813 A | | 1/1978 | Hudson | 2/19 |
| 4,279,681 A | * | 7/1981 | Klimezky | 156/245 |
| 4,891,845 A | * | 1/1990 | Hayes | 2/161.1 |
| 4,937,882 A | | 7/1990 | Hayes | 2/19 |
| 5,031,238 A | * | 7/1991 | Hayes | 2/162 |
| 5,850,633 A | * | 12/1998 | Lovin | 2/162 |

FOREIGN PATENT DOCUMENTS

| | | | |
|---|---|---|---|
| JP | 56-46780 | 11/1981 | A63B/71/14 |
| JP | 6-57378 | 8/1994 | A63B/71/14 |
| JP | 7-213675 | 8/1995 | A63B/71/14 |
| JP | 9-28855 | 2/1997 | A63B/71/14 |

* cited by examiner

*Primary Examiner*—Gary L. Welch
(74) *Attorney, Agent, or Firm*—Troutman Sanders LLP; Gerald R. Ross

(57) ABSTRACT

A baseball glove including a ball receiving member, a back member and a back covering member is provided, in which the back covering member is extended from right and left side portions of a hand receiving portion to an outer side portion of a thumb base and an outer side portion of a little finger base of the back member, and extended in at least one of the directions toward a central line of each finger portion and toward the intervening space between finger portions of the back member from the hand receiving portion.

12 Claims, 3 Drawing Sheets

BASEBALL GLOVE

This invention claims priority to Japanese Application No. 2001-107973(P) filed Apr. 6, 2001 entitled "Baseball Glove."

BACKGROUND OF THE INVENTION

1. Field of the Invention

The present invention relates to improvements in a hand receiving belt for a baseball glove.

2. Description of the Background Art

A hand receiving belt 11 of a conventional baseball glove 1 is generally formed by extending a back member 10 from a region below a thumb base 10*b* to a region below a little finger base 10*a* and engaging the ends thereof as shown in FIG. 5, or by producing a separate piece which extends from the region below the thumb base 10*b* to the region below the little finger base 10*a* of back member 10 and engaging this piece at both ends.

A comfortable fit of a hand into a glove is effectuated by inserting fingers into the respective finger portions and securing a back portion of the hand with a hand receiving belt. Therefore, various methods of securing fingers in the finger portions and of securing with the hand receiving belt are devised as disclosed.

Among improvements of the hand receiving belt, Japanese Utility Model Laying-Open No. 6-57378 discloses a baseball catching gear in which a belt body is attached for sandwiching both sides of the hand being inserted in a hand receiving belt portion. Further, Japanese Patent Laying-Open No. 9-28855 discloses a glove in which a tightening member is inserted between an outer leather and an inner leather of a hand receiving belt portion and the opposite ends thereof is drawn to the outside by an amount arbitrarily set and held.

A devise of securing the back portion is also disclosed for a glove in which an opening portion is not provided between the upper end of hand receiving belt 11 and each finger base as shown in the above noted FIG. 5, and the entire back surface is covered up. For example, in Japanese Utility Model Publication No. 56-46780, a hand receiving portion of the back member covering the entire back surface is divided into three pieces, which are tied with a strip-like piece. Japanese Patent Laying-Open No. 7-213675 shows that an entire region from lower ends of finger stalls of the back member to a part corresponding to a wrist is formed of a stretch fabric, and a fastening belt is formed between a lower end of a little finger portion and a lower end of a thumb portion of the finger stalls.

A required property for a baseball glove desirably includes a good feeling of inserting a hand, a good flexibility at the time of catching a ball, lightness in weight, high durability, and good shape retention.

As in Japanese Utility Model Laying-Open No. 6-57378 and Japanese Patent Laying-Open No. 9-28855 mentioned above, however, although tightening of the hand a, receiving belt portion can adjust the fit of the wrist portion, strong tightening impairs an operation of catching a ball and also a feeling of inserting a hand.

Furthermore, as in Japanese Utility Model Publication No. 56-46780, although the back member covering the entire back surface eliminates injury of the back of the hand in tagging play, it deteriorates the flexibility of the glove at the time of catching a ball and also increases the weight. In addition, it may deteriorate air permeability inside the glove, so that the user feels hot and stuffy. An improvement in this point is made in Japanese Patent Laying-Open No. 7-213675, in which a hand receiving portion is firmly fastened by a fastening belt, resulting in a poor feeling of inserting a hand, similar to the above mentioned Japanese Utility Model Laying-Open No. 6-57378 and Japanese Patent Laying-Open No. 9-28855.

SUMMARY OF THE INVENTION

In order to solve the aforementioned problems, the present invention provides a baseball glove configured with a ball receiving member, a back member and a back covering member, wherein the back covering member is extended from right and left side portions of a hand receiving portion to an outer side portion of a thumb base and an outer side portion of a little finger base of the back member, and extended in at least one of the directions toward a central line of each finger portion and toward the intervening space between finger portions of the back member, from the hand receiving portion.

When the number of the directions toward the central line of each finger portion and/or toward the intervening space between finger portions of the back member from the hand receiving portion of the back covering member is one, the glove has a good flexibility at the time of catching a ball and is light in weight. As the number increases to two, three or more, the glove has a less flexibility and becomes heavy, but it becomes highly durable and less likely to deform.

Furthermore, when the back covering member is formed of a flexible synthetic resin to which a raised fabric having a good feel is affixed at a part to be in contact with the hand, or is formed using a synthetic resin sponge, the glove comes to have a good feeling in inserting a hand, exhibits better resistance to backward bending at the time of catching a ball, and also is light in weight, highly durable and less likely to deform.

In accordance with another aspect, the present invention provides a baseball glove, including: a main body portion formed integrally with a ball receiving member and a back member and having a finger inserting hole for inserting a finger thereto; and a back covering member attached to the back member placed on the side of the finger inserting hole to form a hand receiving portion for receiving a user's hand. The back covering member includes a first protruding portion extending on a little finger portion of the main body portion, a second protruding portion extending on a thumb portion of the main body portion, and a third protruding portion extending on the back member placed between the little finger portion and the thumb portion of the main body portion.

Preferably, a first opening portion is provided between the back member and the back covering portion placed between the first protruding portion and the third protruding portion, and a second opening portion is provided between the back member and the back covering portion placed between the second protruding portion and the third protruding portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
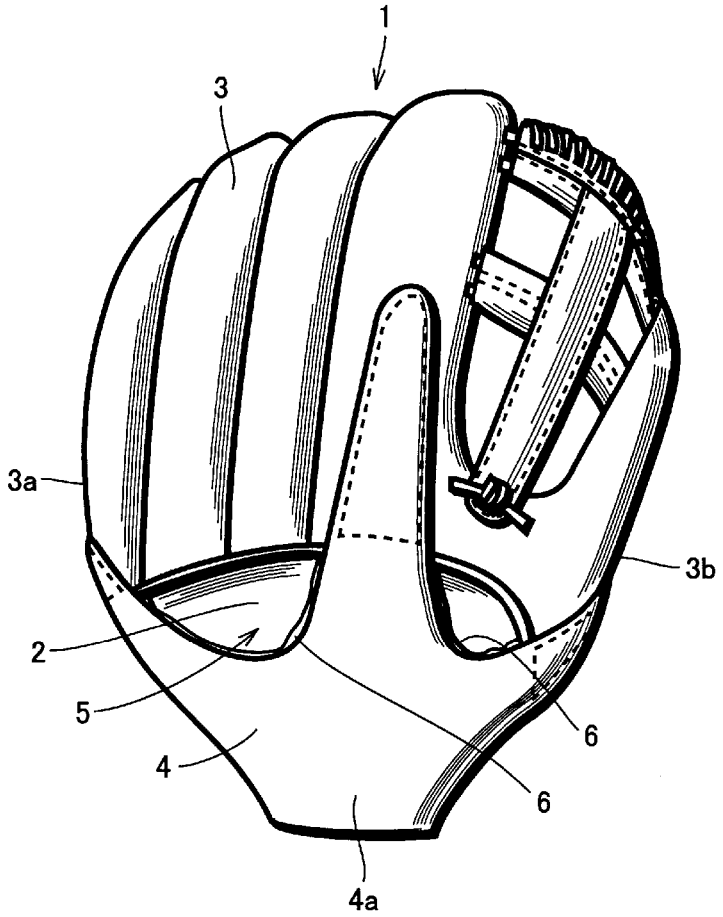
FIG. 1 is a rear view of an embodiment of the present invention.

A baseball glove in accordance with the present invention is configured with a ball receiving member, a back member and a back covering member. Each member can be formed using natural leather, synthetic leather or artificial leather, which is a material for a conventional baseball glove. The back covering member can be formed of a flexible synthetic resin sheet by die-cutting, of a flexible synthetic resin by injection molding, or of synthetic resin sponge by thermoforming.

The ball receiving member and the back member are formed in a manner similar to a conventional baseball glove, except that the back member does not have a hand receiving belt but has an opening portion which is formed from a hand receiving portion to a finger base and integrated with the ball receiving member.

The back covering member covers up the hand receiving portion where the back member has an opening, extends from the right and left side portions of the hand receiving portion to an outer side portion of a thumb base and an outer side portion of a little finger base of the back member, and additionally extends in at least one of the directions toward a central line of each finger portion and toward the intervening space between finger portions of the back member from the hand receiving portion, and is adhered or stitched to the back member. It is noted that the hand receiving portion of the back covering member can be extended below the wrist to cover a large part of a wrist portion.

When the back covering member is formed of a flexible synthetic resin sheet, it is formed by die-cutting a sheet of nylon resin, urethane resin, polyether block amide resin or the like, in view of flexibility and durability. It is noted that a raised fabric, a sponge sheet or the like giving a good feel for the hand is adhered or stitched to a part in contact with the hand.

When the back covering member is formed of flexible synthetic resin by injection molding, nylon, polyurethane elastomer, plolyamide elastomer or the like is used, and a raised fabric, a sponge sheet or the like having a good feel is adhered or stitched to the part in contact with the hand.

When the back covering member is formed of synthetic resin sponge, sponge of EVA or polyurethane is used for thermoforming (hot press). It is noted that when the part in contact with the hand is formed into a thickness of 5–10 mm and the side portion is into a thickness of 2–5 mm, the part in contact with the hand is made soft, and therefore a separate member having a good feeling needs not be attached.

It is preferable that the number of the directions toward the central line of each finger portion and/or toward the intervening space between finger portions of the back member from the hand receiving portion of the back covering member is determined dependent on the characteristics of a position for baseball. Specifically, in case of a glove for an outfielder who has a fewer opportunity of catching a strong hit ball, the back covering member is extended in only one direction, while in case of a glove for an infielder, it is extended in one or two directions. It is noted that when the back covering member is extended into the middle of the finger portion, the glove increases in weight, but it is less likely to bend backward and deform.

Although the back covering member for a catcher mitt can be formed in a similar manner, it is preferably extended in three directions in order to catch a strong thrown ball repeatedly. Specifically, the back covering member is extended in five directions including those extending from the right and left side portions of the hand receiving portion of the back covering member to the outer side portion of the thumb base and the outer side portion of the little finger base of the back member.

Figure 2:
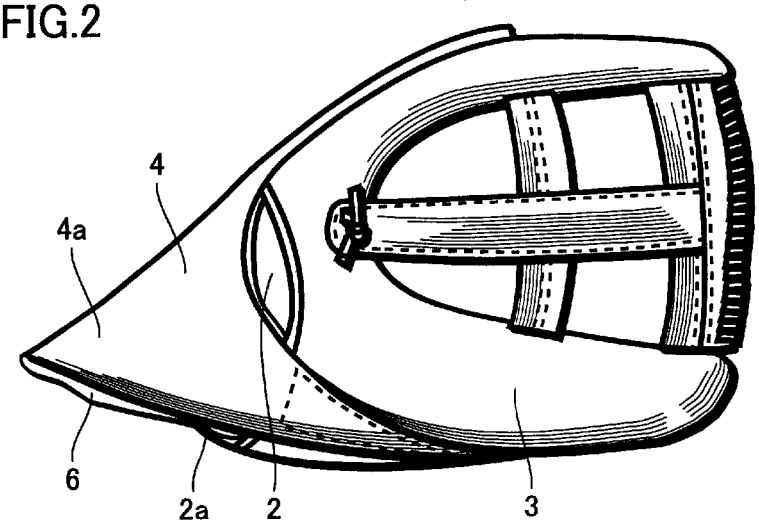
FIG. 2 is a side view seen from the thumb side of FIG. 1.
Figure 3:
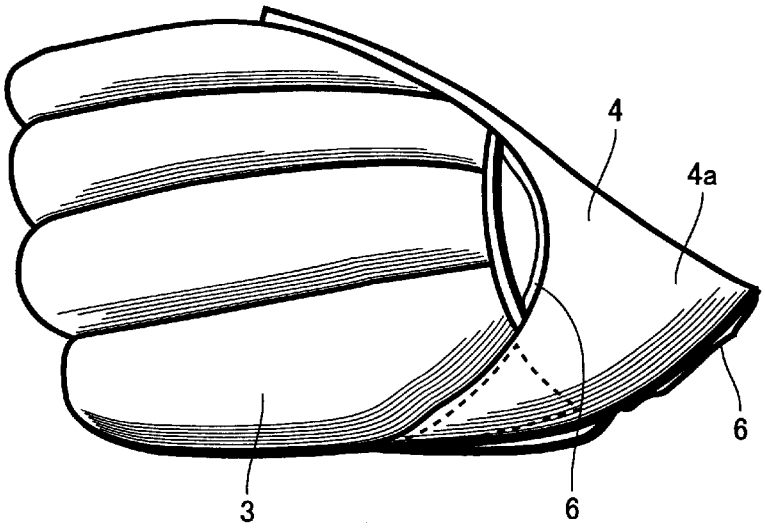
FIG. 3 is a side view seen form the little finger side of FIG. 1.

In the following, an embodiment of the present invention will be described with reference to the figures. FIG. 1 is a rear view of an embodiment, FIG. 2 is a side view seen from the thumb side, and FIG. 3 is a side view seen from the little finger side. A baseball glove 1 of the present invention is formed with a ball receiving member 2 and a back member 3 using natural leather in a manner similar to a conventional glove, except that back member 3 does not have a hand receiving belt 11 but has an opening portion 5 formed from a hand receiving portion 2*a* of ball receiving member 2 to each finger base.

Back covering member 4 is formed by die-cutting a nylon resin sheet having a thickness of 2 mm, and is extended from the right and left side portions of hand receiving portion 4*a* to an outer side portion of a thumb base 3*b* and an outer side portion of a little finger base 3*a* of back member 3 as well as from hand receiving portion 4*a* along a central line of an index finger of back member 3 to half of the index finger lengthwise. The overlapping parts of the extended part and back member 3 are stitched together.

It is noted that hand receiving portion 4*a* of back covering member 4 is extended toward a wrist portion about 5 cm lower than hand receiving portion 2*a* of ball receiving member 2 to cover up the wrist portion. Furthermore, a raised fabric or teaseled part 6 is adhered to a part in contact with the hand.

Figure 4:
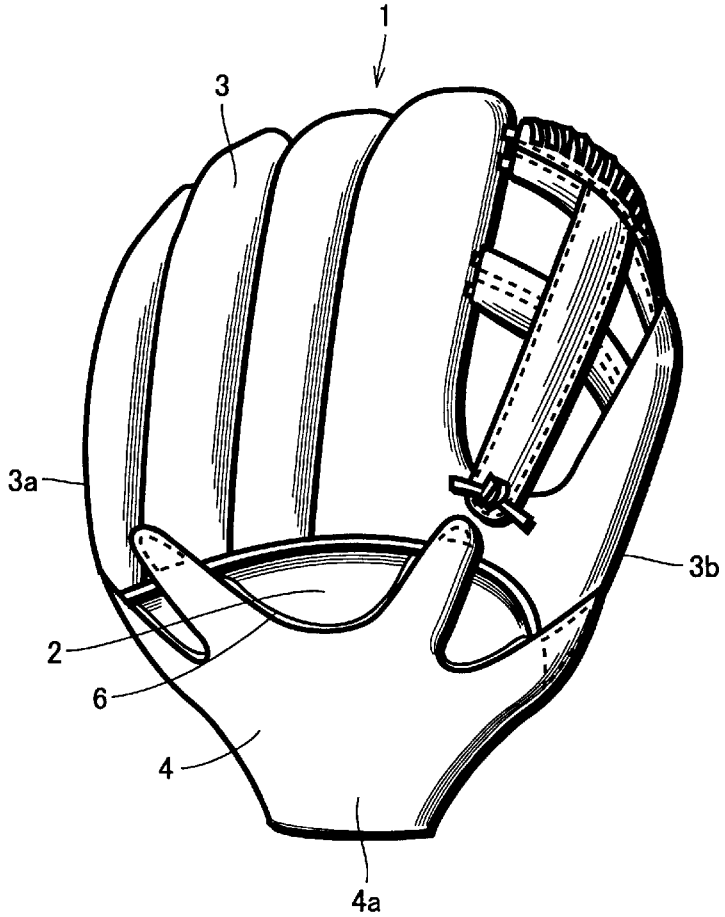
FIG. 4 is a rear view of another embodiment.
Figure 5:
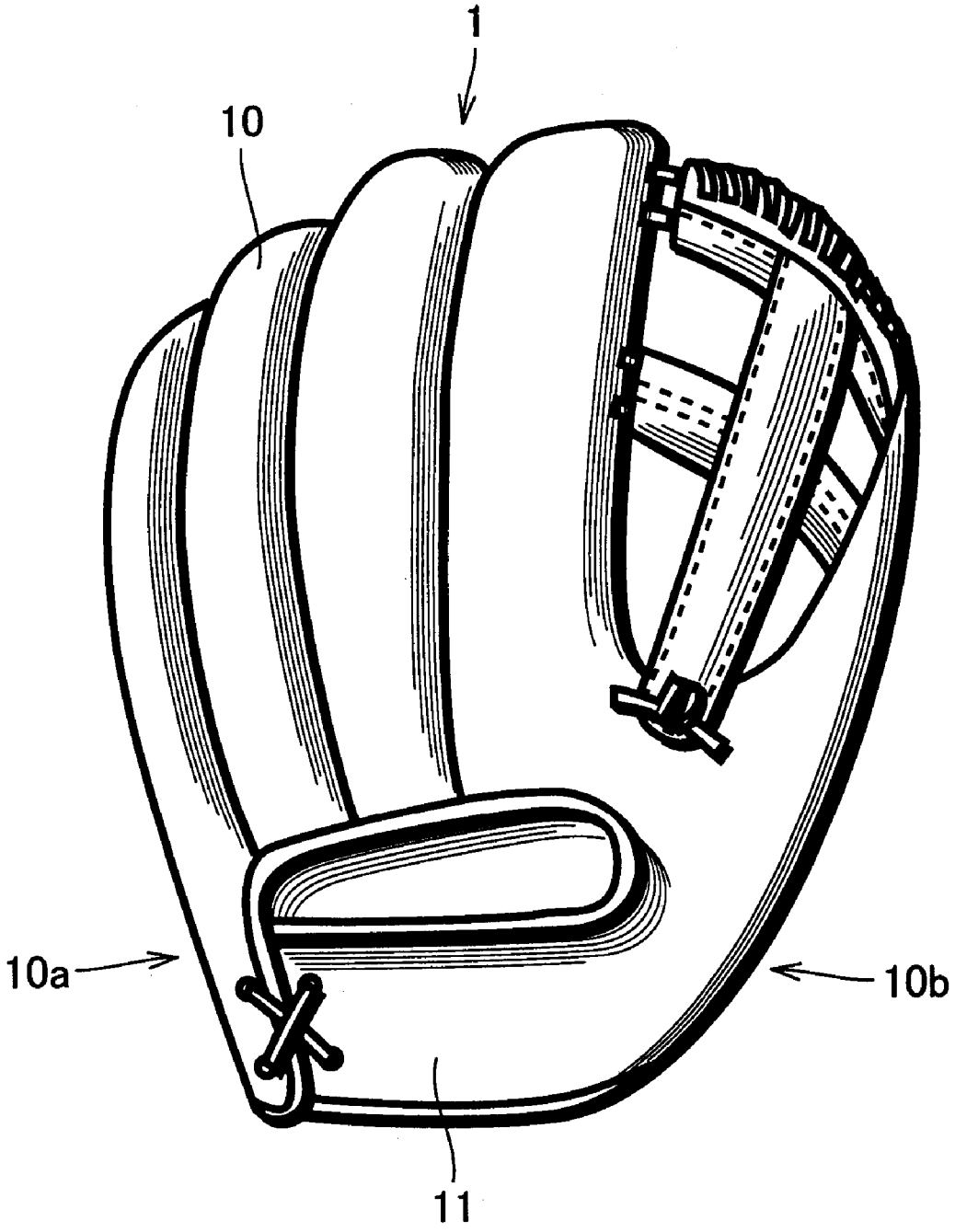
FIG.5 PRIOR ART
FIG. 5 is a rear view of a conventional baseball glove.

FIG. 4 is a rear view of another embodiment. In baseball glove 1 of the present embodiment, again, ball receiving member 2 and back member 3 are formed with natural leather, and back covering member 4 is formed of a nylon resin sheet. Back covering member 4 extends to the outer side portion of little finger base 3*a* and the outer side portion of thumb base 3*b* of back member 3, and extends in the directions toward the central line of the little finger and toward the intervening space between the index finger and the thumb finger of back member 3 from hand receiving portion 4*a*. Raised fabric part 6 is adhered to back covering member 4 at the part in contact with the hand.

Since a hand receiving belt of a baseball glove is made as a back covering member in accordance with the present invention, it is possible to provide a glove which has a good feeling in inserting the hand, has a good flexibility at the time of catching a ball, and is light in weight and less likely to deform.

When the hand receiving portion of the back covering member is extended below the wrist to cover a large part of a wrist portion, a good feeling in inserting the hand into the baseball glove is improved, and the hand can be protected, for example, in tagging play.

Furthermore, an optimum design for each position can be realized by determining the length and the number of the directions toward a central line of each finger portion and/or toward the intervening space between finger portions of the back member from the hand receiving portion of the back covering member, dependent on the characteristics of each position.

Since the back covering member is formed of synthetic resin, it can be easily processed into a solid shape, and it is possible to provide a baseball glove which has a good feeling in inserting a hand, is light in weight, has high durability, and is less likely to deform.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A baseball glove, comprising a ball receiving member, a back member and a back covering member, wherein an opening portion is provided between said back member and said back covering member;

said back covering member is extended from right and left side portions of a hand receiving portion to an outer side portion of a thumb base and a outer side portion of a little finger base of said back member, and further extended through said opening portion and to said back member.

2. The baseball glove according to claim 1, wherein said back covering member is extended through said opening portion and to an index finger portion of said back member.

3. The baseball glove according to claim 1, wherein said back covering member is formed of synthetic resin.

4. A baseball glove, comprising:

a main body portion formed integrally with a ball receiving member and a back member and having a finger inserting hole for inserting a finger thereto; and a back covering member attached to said back member placed on the side of said finger inserting hole to form a hand receiving portion for receiving a user's hand, wherein said back covering member has a first protruding portion extending from an edge of said back covering member in proximity to a user's wrist to a little finger portion of said main body portion, a second protruding portion extending on a thumb portion of said main body portion and a third protruding portion on said back member placed between the little finger portion and the thumb portion of said main body potion;

wherein a first opening portion is provided between said back member and said back covering member placed between said first protruding portion and said protruding portion, and wherein a second opening portion is provided between said back member and said back covering member placed between said second protruding portion and said third protruding portion.

5. The baseball glove according to claim 4, wherein said back covering member is formed of synthetic resin.

6. A baseball glove comprising:

a back member; and a back covering member;

wherein an opening portion is provided between the back member and the back covering member;

the back covering member secured to the back member by at least one protruding portion extending from the back covering member though the opening portion and to the back member.

7. The baseball glove of claim 6, the back covering member releasably secured to the back member.

8. The baseball glove of claim 6, the back covering member fixedly secured to the back member.

9. The baseball glove of claim 6, the back member having a finger portion, the at least one protruding portion secured to a central line of the finger portion of the back member.

10. The baseball glove of claim 6, the back covering member comprising a flexible synthetic resin.

11. The baseball glove of claim 10, the back covering member further comprising a raised fabric secured at a part to be in contact with a hand of a user of the glove.

12. The baseball glove of claims 6, the back covering member formed by thermoforming.

* * * * *